US007332670B2

(12) United States Patent
Fujiwara et al.

(10) Patent No.: US 7,332,670 B2
(45) Date of Patent: Feb. 19, 2008

(54) AUTOMATIC PLAYER EXACTLY BRINGING PEDAL TO HALF POINT, MUSICAL INSTRUMENT EQUIPPED THEREWITH AND METHOD USED THEREIN

(75) Inventors: Yuji Fujiwara, Hamamatsu (JP); Koichi Ishizaki, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 135 days.

(21) Appl. No.: 11/168,262

(22) Filed: Jun. 27, 2005

(65) Prior Publication Data

US 2006/0021488 A1 Feb. 2, 2006

(30) Foreign Application Priority Data

Jul. 27, 2004 (JP) ..... 2004-218359
Mar. 23, 2005 (JP) ..... 2005-084887

(51) Int. Cl.
*G10H 1/32* (2006.01)
*G10H 3/00* (2006.01)

(52) U.S. Cl. ..... 84/744; 84/719; 84/743

(58) Field of Classification Search ..... None
See application file for complete search history.

(56) References Cited

U.S. PATENT DOCUMENTS 5,131,306 A 7/1992 Yamamoto
2004/0055444 A1* 3/2004 Ishii et al. ..... 84/604
2005/0092160 A1* 5/2005 Fujiwara ..... 84/600
2005/0145104 A1* 7/2005 Sasaki ..... 84/746

FOREIGN PATENT DOCUMENTS

JP 8-44348 A 2/1996

* cited by examiner

*Primary Examiner*—Marlon T Fletcher
(74) *Attorney, Agent, or Firm*—Morrison & Foerster LLP

(57) ABSTRACT

An automatic player reenacts a music passage on an acoustic piano without any fingering of a human player; solenoid-operated key actuators and a solenoid-operated pedal actuator is provided for the keys and damper pedal; the automatic player makes the damper pedal travel along a simulative pedal trajectory, and the central processing unit stores pieces of control data expressing the pedal stroke together with the amount of mean current supplied to the solenoid-operated pedal actuator; the central processing unit analyzes the pieces of control data so as to determine an entry point of half pedal section and an exit point of the half pedal section, and specifies a target half point in the half pedal section; while reenacting a music passage, the automatic player brings the damper pedal to the half point so as to reproduce the half pedal state, exactly.

21 Claims, 8 Drawing Sheets

AUTOMATIC PLAYER EXACTLY BRINGING PEDAL TO HALF POINT, MUSICAL INSTRUMENT EQUIPPED THEREWITH AND METHOD USED THEREIN

FIELD OF THE INVENTION

This invention relates to an automatic player musical instrument and, more particularly, to an automatic player musical instrument having pedals for modifying tones.

DESCRIPTION OF THE RELATED ART

An automatic player piano is a typical example of the automatic player musical instrument, and music fans are familiar with the automatic player piano. The automatic player piano is a combination between an acoustic piano and an automatic player. The automatic player has solenoid-operated key actuators, solenoid-operated pedal actuators and a controller. The solenoid-operated key actuators are provided under the rear portions of the black and white keys, and the controller selectively energizes the solenoid-operated key actuators so as to give rise to the key motion without any fingering of a human player. The solenoid-operated pedal actuators are provided for the pedals such as the damper pedal and soft pedal, and the controller supplies the driving signal to the solenoid-operated pedal actuators so as selectively to push down the pedals. Thus, the automatic player gives rise to the key motion and pedal motion, and reenacts a performance on the acoustic piano.

While a human player is pushing down the damper pedal, the damper pedal is traveling along a pedal path, and the pedal path is imaginarily divided into three sections. The first section is from the rest position to a certain point on the pedal path, and the pedal linkwork does not exert any substantial force on the damper during the travel in the first section. The first section is hereinbelow referred to as "rest section".

The second section is from the certain point to another point on the pedal path at which the damper starts to leave the string. While the damper pedal is traveling in the second section, the self-weight of the damper is gradually reduced from the string. The second section is hereinbelow referred to as "half-pedal section, and the damper pedal and damper are called to be in "half-pedal state". The certain point at which the pedal linkwork starts to reduce the self-weight of damper is referred to as an "entry point", and the point at which the pedal linkwork reduces the self-weight of damper on the strings to zero is referred to as an "exit point".

The third section is from the exit point to the end position, and any force is not exerted on the string during the travel in the third section. The third section is hereinbelow referred to as "open string section", and the damper pedal and damper are called to be in "open string state". Thus, the damper pedal is moved between the rest position and the end position through the rest section, half pedal section and open string section.

The damper produces different influences on the tones depending upon the section on the pedal path. Especially, human pianists positively produce the influence of the damper in the half pedal state during their performances, and put artificial expression into their performances.

The automatic player is expected exactly to produce the half pedal state during the playback. However, it is difficult to specify the half pedal section, i.e., the entry point and exit point for all the acoustic pianos. This is because of the fact that the half pedal section, i.e., the entry point and exit point are dependent on the individuality of the acoustic pianos. In fact, the solenoid-operated pedal actuator does not exhibit the current-to-plunger stroke characteristics strictly same as those of other solenoid-operated pedal actuators, and different amount of play are introduced into the pedal linkwork. For this reason, the automatic player of each automatic player piano is expected to determine the half stroke section through an experiment.

A typical example of the method for determining the half stroke section is disclosed in Japanese Patent No. 2606616. The Japanese Patent No. 2606616 is based on Japanese Patent Application No. Hei 7-159700, and the Japanese Patent Application was published as Japanese Patent Application laid-open No. Hei 8-44348. A U.S. Patent Application was filed on the basis of the Japanese Patent Application, and was granted as U.S. Pat. No. 5,131,306.

The prior art method is developed on the basis of the fact that the plunger stroke is hardly increased in the half stroke section even if the duty ratio of the driving signal is gradually increased. Accordingly, the prior art automatic player stepwise increases the duty ratio of the driving signal, and monitors the plunger stroke with a suitable sensor. Any servo control is not employed therein. While the pieces of data express small increment of the plunger stroke, the controller decides that the damper pedal is traveling in the half pedal section.

Although the half pedal section is theoretically recognized, it is hard actually to determine a target value of the duty ratio of the driving signal, because the increment of pedal stroke is an extremely small value in the half pedal section where the duty ratio is fairly increased. Moreover, the individuality of the acoustic piano has serious influence on the half pedal state. For example, the solenoid-operated pedal actuators do not exhibit strictly identical duty ratio-to-pedal stroke characteristics. This means that the manufacturer can not uniquely determine the target value of the duty ratio for all the products of the prior art automatic player piano.

SUMMARY OF THE INVENTION

It is therefore an important object of the present invention to provide an automatic player, which exactly reproduces the half pedal state in an automatic playing.

It is also an important object of the present invention to provide a musical instrument, which is equipped with the automatic player.

It is another important object of the present invention to provide a method for controlling the half pedal.

The present inventors contemplated the problem inherent in the prior art automatic player piano, and noticed that senior pianists had kept the damper pedals in a certain region in the pedal stroke. The present inventors firstly correlated a standard time period over which ordinary pianists used to prolong the tones, secondly correlated the standard time period with a certain value of a piece of music data expressing the pedal stroke, and finally correlated the certain value with a unique point on the pedal locus which was to be discriminative for a computer machine. The present inventors concluded that the unique point was to be determined through arithmetic and logical operations, and that the mathematically unique point was to be determined on the basis of load curves obtained through experiments for individual products of the automatic playing musical instrument.

In accordance with one aspect of the present invention, there is provided an automatic player for reenacting a performance on a musical instrument having plural manipulators for specifying the pitch of tones, a tone generator for producing the tones at the pitch and at least one manipulator for imparting an effect and another effect to the tones depending upon a stroke from a rest position; and the automatic player comprises plural actuators associated with the plural manipulators and selectively energized for moving the plural manipulators between the rest positions and the end positions, an actuator associated with the aforesaid at least one manipulator and energized for moving the aforesaid at least one manipulator into an end section in the presence of a piece of music data representative of the effect and to a half section in the presence of another piece of music data representative of the aforesaid another effect, a trajectory for the aforesaid at least one manipulator being dividable into a rest section, the half section and the end section, a sensor producing pieces of control data representative of an actual position of the aforesaid at least one manipulator on the trajectory and a controller connected to the plural actuators, the actuator and the sensor and responsive to pieces of music data representative of a music passage so as selectively to energize the plural actuators and the actuator for producing the music passage, the controller is further responsive to pieces of test data representative of a simulative trajectory so as to move the aforesaid at least one manipulator along the simulative trajectory overlapped with at least a part of the rest section, the half section and a part of the end section, thereby gathering the pieces of control data respectively paired with pieces of driving data representative of load on the actuator, and the controller analyzes the pieces of control data respectively paired with the pieces of driving data so as to determine a mathematically unique point in the half section through arithmetic operations, whereby the controller brings the aforesaid at least one manipulator to the mathematically unique point in the presence of the aforesaid another piece of music data for imparting the aforesaid another effect to the tones.

In accordance with another aspect of the present invention, there is provided a musical instrument for producing tones comprising plural manipulators selectively moved from respective rest position to respective end positions for specifying the pitch of the tones, a tone generator connected to the plural manipulators and responsive to the manipulators moved toward the end positions for producing the tones at the specified pitch, at least one manipulator moved between a rest position and an end position through a rest section, a half section and an end section and imparting an effect to the tones in the end section and another effect to the tones in the half section, and an automatic player including plural actuators associated with the plural manipulators and selectively energized for moving the plural manipulators between the rest positions and the end positions, an actuator associated with the aforesaid at least one manipulator and energized for moving the aforesaid at least one manipulator into the end section in the presence of a piece of music data representative of the effect and into the half section in the presence of another piece of music data representative of the aforesaid another effect, a sensor producing pieces of control data representative of an actual position of the aforesaid at least one manipulator on a trajectory between the rest position and the end position and a controller connected to the plural actuators, the actuator and the sensor and responsive to pieces of music data representative of a music passage for selectively energizing the plural actuators and the actuator; the controller is further responsive to pieces of test data representative of a simulative trajectory for moving the aforesaid at least one manipulator along the simulative trajectory overlapped with at least a part of the rest section, the half section and a part of the end section for gathering the pieces of control data respectively paired with pieces of driving data representative of load on the actuator; and the controller analyzes the pieces of control data respectively paired with the pieces of driving data so as to determine a mathematically unique point in the half section through arithmetic operations, whereby the controller brings the aforesaid at least one manipulator to the mathematically unique point for imparting the aforesaid another effect to the tones.

In accordance with yet another aspect of the present invention, there is provided a method for seeking a mathematically unique point comprising the steps of a) determining a simulative trajectory containing a part of rest section, a half section and a part of an end section for at least one manipulator of a musical instrument on the basis of pieces of test data, b) moving the at least one manipulator along the simulative trajectory by means of an actuator so as to gather pieces of control data representative of an actual position of the aforesaid at least one manipulator respectively paired with pieces of driving data representative of a load on the actuator and c) analyzing the pieces of control data respectively paired with the pieces of driving data so as to determine a mathematically unique point in the half section through arithmetic operations so that the aforesaid at least one manipulator is brought into the mathematically unique point for imparting an effect to the tones.

BRIEF DESCRIPTION OF THE DRAWINGS

The features and advantages of the automatic player, musical instrument and method will be more clearly understood from the following description taken in conjunction with the accompanying drawings, in which.

DESCRIPTION OF THE PREFERRED EMBODIMENTS

Figure 1:
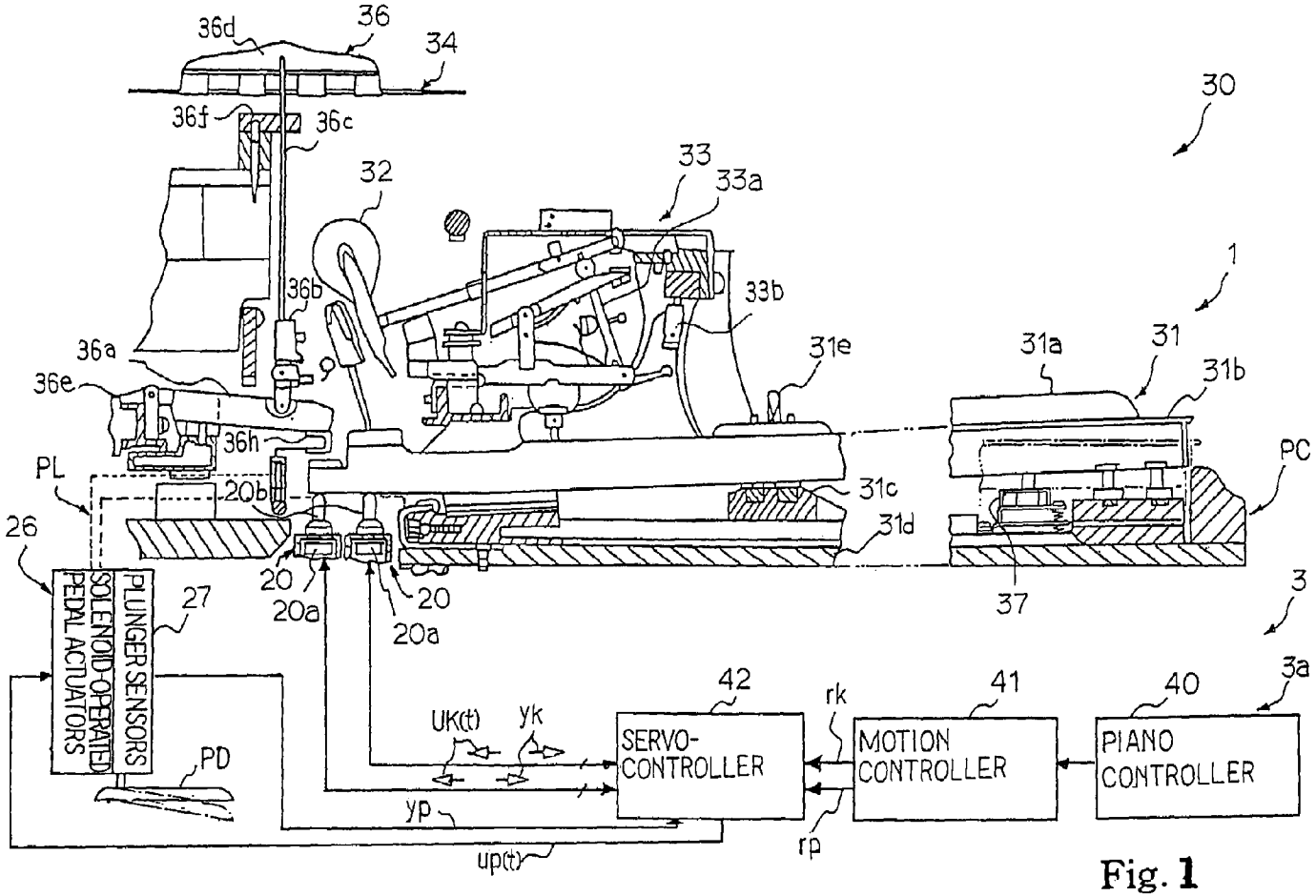
FIG. 1 is a side view showing the structure of an automatic player piano according to the present invention.

In the following description, term "half point" is defined as a target point in the half pedal section for which a controller targets a manipulator. Although the present invention appertains to all the manipulators of a musical instrument, description is made on a damper pedal of an acoustic piano, because the damper pedal is popular to players.

Pianists depress the damper pedal into various values of depth in the half pedal section for prolonging the tones. The time period over which the tones are sustained is varied depending upon the pedal stroke in the half pedal section so that the pianists delicately control the pedal stroke for their artificial expression. The pianists experientially correlate the sustaining time period with the pedal stroke, and can delicately regulate the pedal stroke through their biotic feedback loops. However, it is impossible to realize the human capability in a computer system. For this reason, the half point is required for the controlling machine to be installed in the piano. If the manufacture makes a reference sustaining time corresponding to the half point for the controlling machine, the controlling machine can prolong or shorten the sustaining time with a piece of control data indicative of an offset from the reference sustaining time.

The present inventors experimentally sought a standard value of the sustaining time period, and found the standard value to be 1.5 seconds. The standard value is about 50% of the sustaining time under the full stroke of the damper pedal. For this reason, the present inventors employed the standard value, i.e., 1.5 seconds as the reference sustaining time period, and made the standard value, i.e., 1.5 seconds corresponding to a certain value of the piece of music data expressing the pedal stroke. Of course, it was possible to make another value of the sustaining time period to another point in the pedal stroke. In other words, the standard value of 1.5 seconds and mid value do not set any limit to the technical scope of the present invention.

Subsequently, the present inventors correlated the certain value of the piece of music data with the half point. If the controlling machine had exhibited a capability as high as human pianists, the present inventors would have given the training to the controlling machine so as to establish the quasi biotic feedback loop in the controlling machine. However, such an unreal idea was not employed. Instead, the present inventors put the half point to a mathematically unique point, because the control machine was very good at arithmetic and logical operations.

An automatic player musical instrument embodying the present invention largely comprises an acoustic musical instrument and an automatic player, and the automatic player reenacts a performance on the acoustic musical instrument without any fingering of a human player. Although various acoustic musical instruments are capable of forming a part of the automatic player musical instrument, description is hereinafter made on an automatic player piano, because the automatic player piano is well known to persons skilled in the art. The acoustic piano includes black and white keys, actions, hammers, strings, dampers and some pedals. One of the pedals is known as "damper pedal", and human pianists depress the damper pedal for prolonging the tones. The black and white keys stand for the "plural manipulators", and the damper pedal serves as "at least one manipulator", by way of example. The action units, hammers, strings and dampers as a whole constitute the "tone generator". The automatic player includes a controller, plural actuators for the black and white keys, at least one actuator for the damper pedal and a sensor for measuring the pedal stroke.

There are various styles of rendition. For example, the human pianist brings the damper pedal to the half pedal state. The style of rendition is called as "half pedal" in order to discriminate the half pedal from the full stroke of the damper pedal. Although the half pedal makes the tones fairly prolonged, the tones in the half pedal are shorter than the tones in the full stroke. Thus, the human player gives artificial expression to his or her performance by using the damper pedal.

The automatic player is expected exactly to reproduce the half pedal in the playback. However, the acoustic pianos exhibit different individuality. In other words, the pedal stroke for the half pedal state is delicately different among the acoustic pianos. For this reason, the half pedal section is to be determined for the individual acoustic pianos through experiments.

If a skilled tuner carried out the experiments, he or she would exactly specify the half pedal section and the half point for each acoustic piano. However, it is impossible for skilled tuners periodically to visit all the users after the delivery thereto. This means that the automatic player per se determines the half point for the associated acoustic piano through the experiment. The controller firstly determines a simulative pedal trajectory on the basis of pieces of test data, and energizes the at least one actuator so as to force the damper pedal to travel on the simulative pedal trajectory. The controller forces the damper pedal to travel on the simulative pedal trajectory through a servo control loop. While the damper pedal is traveling on the simulative pedal trajectory, the controller memorizes pieces of driving data representative of the amount of mean current supplied to the at least one actuator therein at intervals, and receives pieces of control data from the sensor at the interval. The pieces of control data are respectively paired with the pieces of driving data, and are also memorized therein.

The individuality of acoustic piano has influence on the pieces of control data so that the controller determines a load curve on the basis of the pieces of control data respectively paired with the pieces of driving data. Then, the controller analyzes the load curve or the pieces of control data respectively paired with the pieces of driving data. The controller can not measure the time period over which the tones are produced. In other words, it is necessary for the controller to be informed of a particular feature of the half point to which the controller brings the damper pedal. The particular feature is to be discriminative through arithmetic and logical operations, because the controller has the ability to carry out the arithmetic and logical operations.

The present inventors investigated the load curve, and found some mathematically unique points in the half pedal section into which most of senior players brought the damper pedal. One of the mathematically unique points is specified through the interior division, and another mathematically unique point is specified as an inflection point on the load curve. Yet another mathematically unique point is determined through the subtraction. The controller can accomplish the interior division, analysis for the inflection point and subtraction through the arithmetic operations. Thus, the controller can determines the half point without any assistance of the skilled human tuner.

Terms "front", "rear", "fore-and-aft direction", "lateral direction" and "up-and-down direction" are determined as follows. Term "front" is indicative of a position closer to a player, who is sitting on a stool for fingering, than a position modified with term "rear". A line drawn between a front position and a corresponding rear position extends in the "fore-and-aft direction", and the "lateral direction" crosses the fore-and-aft direction at right angle. The "up-and-down direction" is normal to a plane defined by the fore-and-aft direction and lateral direction.

First Embodiment

Referring first to FIG. 1 of the drawings, an automatic player piano 30 embodying the present invention largely comprises an acoustic piano 1 and an automatic player 3. While a human pianist plays a piece of music on the acoustic piano 1, the automatic player 3 stands idle, and acoustic piano tones are produced in the acoustic piano 1 along a music passage. The automatic player 3 responds to user's instruction for playback, and reenacts the performance without any fingering by the human pianist. Although a recording system is further incorporated in the automatic player piano 1 for recording a performance on the acoustic piano 1, the system configuration and system behavior are well known to persons in the art, and detailed description is omitted for the sake of simplicity. The acoustic piano 1 and automatic player 3 is hereinafter described in detail.

Structure of Acoustic Piano

In this instance, the acoustic piano 1 is a standard grand piano. Of course, an upright piano is available for the automatic player piano 30. The acoustic piano 1 includes a keyboard 31, hammers 32, action units 33, strings 34, dampers 36, a piano cabinet PC and pedals PD. The keyboard 31 is mounted on a front portion of a piano cabinet PC, and is exposed to a pianist, who is sitting on a stool (not shown) in front of the piano cabinet PC for playing a piece of music. The action units 33, hammers 32, strings 34 and dampers 36 are housed inside the piano cabinet PC, and the inner space is open to the ambience while a top board (not shown) is folded. The action units 33 and dampers 36 are linked with the keyboard 31, and are selectively actuated by the pianist through the keyboard 31. The hammers 32 are actuated by the action units 33, and the strings 34 are struck with the hammers 32 for producing the acoustic piano tones.

The keyboard 31 includes black keys 31*a* and white keys 31*b*, and the black keys 31*a* and white keys 31*b* are laid on the well-known pattern. A balance rail 31*c* laterally extends over a key bed 31*d*, which defines the bottom of the piano cabinet PC, and the black keys 31*a* and white keys 31*b* rest on the balance rail 31*c* in such a manner as to cross the balance rail 31*c* at right angle. Balance pins 31*e* upwardly project from the balance rail 31*c* at intervals, and offer fulcrums to the black/white keys 31*a*/31*b*. When a user depresses the front end portions of the black and white keys 31*a*/31*b*, the front end portions are sunk toward the key bed 31*d*, and the rear portions are lifted. Thus, the black and white keys 31*a*/31*b* pitch up and down like a seesaw.

The black/white keys 31*a*/31*b* are respectively linked with the action units 33 so that depressed keys 31*a*/31*b* actuate the associated action units 33. The hammers 32 rest on the jacks 33*a*, which form respective parts of the action units 33 together with regulating buttons 33*b*. When the toes of the jacks 33*a* are brought into contact with the associated regulating buttons 33*b*, the jacks 33*a* escape from the associated hammers 32, and exert the force on the hammers 32. Then, the hammers 32 start free rotation toward the associated strings 34. Thus, the hammers 32 are driven for the free rotation through the escape of the jacks 33*a*.

The strings 34 are stretched over the associated hammers 32, and are struck with the associated hammers 32 at the end of the free rotation. While the black and white keys 31*a*/31*b* are staying at the rest positions, the dampers 36 are held in contact with the associated strings 34, and prevent the associated strings 34 from vibrations. The depressed keys 31*a*/31*b* make the associated dampers 36 spaced from the strings 34 on the way to the end positions. Then, the strings 34 get ready for vibrations.

Each of the dampers 36 includes a damper lever 36*a*, a damper block 36*b*, a damper wire 36*c* and a damper head 36*d*. The damper lever 36*a* is rotatably supported by a damper lever flange 36*e*, and has a front end portion over the rear end portion of the associated black/white key 31*a*/31*b*. While the pianist is exerting the force on the front portion of the associated black/white key 31*a*/31*b*, the rear end portion rises, and upwardly pushes the front end portion of the damper lever 36*a*. Thus, the depressed black/white key 31*a*/31*b* gives rise to the rotation of the damper lever 36*a* about the damper lever flange 36*e*.

The damper block 36*b* is pivotally connected to the middle portion of the damper lever 36*a*, and the lower end of the damper wire 36*c* is embedded in the damper block 36*b*. The damper wire 36*c* is upright on the damper block 36*b*, and passes through a guide rail 36*f*. The damper wire 36*c* is connected at the upper end thereof to the damper head 36*d*, and a damper felt, which forms a part of the damper head 36*d*, is held in contact with the strings 34. The damper felts are not strictly equal in height to one another.

While the depressed black/white key 31*a*/31*b* is upwardly pushing the damper lever 36*a*, the force is transmitted from the damper lever 36*a* through the damper wire 36*c* to the damper head 36*d* so that the damper head 36*d* is spaced from the string 34. When the pianist releases the depressed black/white key 31*a*/31*b*, the rear portion of black/white key 31*a*/31*b* is sunk due to the self-weight of the damper 36, and the damper head 36*d* is brought into contact with the string 34, again. Thus, the dampers 36 prevent the associated strings 34 from vibrations, and permit the associated strings 34 to vibrate for producing the acoustic piano tones.

The pedals PD are provided under the key bed 31*d*, and are connected to a damper block 36*h*, a sostenuto rod and the keyboard 31 through associated linkworks PL. The human player steps on the pedals PD during the performance so as to put the artificial expression into the piano tones. One of the pedals PD is called as a "damper pedal", and makes the piano tones prolonged. Another of the pedals PD is called as a "soft pedal", and makes the piano tones reduced in loudness. Yet another pedal PD is called as a "sostenuto pedal", and makes particular tones prolonged. The damper pedal, soft pedal and sostenuto pedal drive the damper block 36*h*, keyboard 31 and sostenuto rod, respectively. While a pianist is playing a piece of music on the acoustic piano 1, he or she not only depresses the damper pedal PD to the end position for prolonging the tones but also steps on the damper pedal PD for the half pedal state. The dampers 36 pass through the rest section and half pedal section, and enter the open string section. While the dampers 36 are traveling in the rest section, the load against the pedal motion is merely slightly increased. As described hereinbefore, the damper felts are not strictly equal in height to one another, and, for this reason, the damper felts do not concurrently leave the strings 34. In other words, the half pedal section is different in length among the dampers 36. This means that the pianist feels the load against the damper pedal PD surely increased while the dampers 36 are traveling in the half pedal section. The pianist may stop the damper pedal PD at the half point, which is fallen within the predetermined range in the half pedal section. Otherwise, he or she further depresses the damper pedal PD, and makes the dampers 36 enter the open string section. The load against the pedal motion is merely slightly increased in the open string section.

Functions of Automatic Player

The automatic player 3 includes a controller 3*a*, an array of solenoid-operated key actuators 20 and solenoid-operated pedal actuators 26. The controller 3*a* has a data processing capability, and suitable computer programs are installed therein. The solenoid-operated key actuators 20 and solenoid-operated pedal actuators 26 are connected to the controller 3*a*.

The solenoid-operated key actuators 20 are provided under the rear portions of the black and white keys 31*a*/31*b*, and the controller 3*a* selectively energizes the solenoid-operated key actuators 20 for driving the associated black and white keys 31*a*/31*b* without any fingering of the human player. On the other hand, the solenoid-operated pedal actuators 26 are provided over the rear portions of the pedals PD, and push down the associated pedals PD without any step-on of the human player. The total weight of the pedal system PD/PL/36, which the solenoid-operated pedal actuator 26 is expected to drive, is heavier than the total weight of the key/action unit/each damper 36/each hammer 32, which the solenoid-operated key actuator 20 is expected to drive. Thus, the solenoid 28 is expected to create the magnetic field stronger than that created by the solenoid of the solenoid-operated key actuator 20.

The solenoid-operated key actuators 20 have respective built-in plunger sensors 20*a*, respective solenoids (not shown) and respective plungers 20*b*, and the plungers 20*b* have the respective tips beneath the rear portions of the black and white keys 31*a*/31*b*. The solenoid-operated pedal actuators 26 also have respective plunger sensors 27, respective solenoids 28 and respective plungers 29 (see FIG. 2). The plungers 29 are inserted into the link works PL, and drive the dampers block 36*h*, keyboard 31 and sostenuto rod as if the human player steps on the pedals PD.

When a user wishes to reproduce a performance, the user instructs the controller 3*a* to get ready for a playback, and a set of MIDI (Musical Instrument Digital Interface) music data codes, which represents the performance, is loaded to the controller 3*a*. The controller 3*a* sequentially processes the MIDI music data codes so as to determine reference key trajectories on which the black and white keys 31*a*/31*b* are to travel. The reference key trajectory is a series of values of target key potion varied with time. If the black and white keys 31*a*/31*b* exactly travel along the reference key trajectories, the black and white keys 31*a*/31*b* pass respective reference key points at target values of reference key velocity. Since the reference key velocity is proportional to the hammer velocity immediately before the impact on the strings 34, the acoustic piano tones are produced at target values of loudness. Thus, the black and white key 31*a*/31*b* on the reference key trajectory guides the hammer 32 to the target hammer velocity so as to produce the tone at the target loudness.

When timing at which a certain key 31*a*/31*b* is to be moved comes, the controller 3*a* supplies a driving signal uk(t) to the solenoid-operated key actuator 20 under the certain key 31*a*/31*b*, and energizes the solenoid (not shown) with the driving signal uk(t). Then, the plunger 20*b* projects upwardly, and pushes the rear portion of the certain key 31*a*/31*b*. The built-in plunger sensor 20*a* reports the current plunger position, which is almost equivalent to the current key position, through a plunger position signal yk to the controller 3*a*. The controller 3*a* compares the current plunger position and current plunger velocity, which is equivalent to the current key velocity, with the corresponding target key position and target key velocity on the reference key trajectory to see whether or not the certain key 31*a*/31*b* accurately travels on the reference trajectory. If the answer is given negative, the controller 3*a* varies the mean current of the driving signal uk(t) so as to accelerate or decelerate the plunger 20*b*. On the other hand, when the controller 3*a* confirms that the certain key 31*a*/31*b* accurately travels on the reference key trajectory, the controller 3*a* keeps the driving signal u (k) at the mean current. Thus, the controller 3*a* sequentially drives the plungers 20*b* so as to give rise to the key motion same as that in the original performance. The black and white keys 31*a*/31*b* actuate the associated action units 33, and cause the hammers 32 to be brought into collision with the associated strings 34 at the end of the free rotation for producing the acoustic piano tones.

The human player sometimes prolonged a piano tone in the original performance. When the timing at which the prolonged piano tone is to be reproduced in the playback, the controller 3*a* also determines a reference pedal trajectory for the damper pedal PD, and the mean current of the driving signal up (t). The driving signal up(t) is supplied to the solenoid 28 so that a magnetic field is created around the plunger 29. The magnetic force is exerted on the plunger 29 so that the plunger 29 gives rise to the pedal motion. Although a time lag takes place due to the large time constant, the driving signal up(t) makes the plunger 29 rapidly accelerated so that the pedal PD can catch up to the target position on the reference pedal trajectory at the early stage in the plunger motion. While the plunger 29 is moving the pedal PD and associated linkwork PL, the pedal sensor 27 reports the current plunger position, i.e., the current pedal position through a plunger position signal yp to the controller 3*a*. The controller 3*a* varies or keeps the mean current of the driving signal up(t) as similar to the driving signals UK(t) supplied to the solenoid-operated key actuators 20.

The magnetic force is balanced with the load on the damper pedal PD. As described hereinbefore, the damper felts do not concurrently leave the strings 34. In other words, the load is stepwise increased, and the amount of mean current or duty ratio of driving signal up(t) is gradually increased in the half pedal section. The gradient of load curve CA is relatively large. When all of the damper felts leave the strings 34, all the self-weight is exerted on the damper pedal PD. Even though the dampers 36 are further lifted by the solenoid-operated pedal actuator 26, the amount of mean current or duty ratio is not so widely increased, and the gradient of load curve CA is extremely small.

When the piece of music data requests the controller 3*a* to bring the damper pedal PD into the half pedal state, the solenoid-operated pedal actuator 26 moves the damper pedal PD to the half point.

A computer program runs on the controller 3*a*, and the controller 3*a* achieves the above-described tasks through the execution of the program instructions. The function of the controller 3*a* is broken down into a function of a piano controller 40, a function of a motion controller 41 and a function of a serve-controller 42.

The piano controller 40 sequentially fetches the MIDI music data codes from a suitable data source, and supplies the MIDI music data codes to the motion controller 41 at the timing to reproduce each of the piano tones. A set of MIDI music data codes contains pieces of music data, which define the key motion and pedal motion, and pieces of duration data representative of the lapse of time between an event and the next event. The piano controller 40 determines the timing on the basis of the pieces of duration data, and supplies the piece or pieces of music data representative of the key position and/or pedal motion to the motion controller 41.

The motion controller 41 analyzes the pieces of music data, and determines the reference key trajectories. As described hereinbefore, the reference key trajectory means a series of target key positions varied with time, and the reference pedal trajectory means a series of target pedal positions also varied with time. The motion controller 41 supplies a piece of key position data representative of the target key positions rk and a piece of pedal position data representative of the target pedal positions rp to the servo-controller 42 at regular intervals.

The servo-controller 42 is connected to the solenoid-operated key actuators 20, built-in plunger sensors 20*a*, solenoid-operated pedal actuators 26 and plunger sensors 27. The servo-controller 42 determines the mean current of the driving signal UK(t) required for moving the key 31*a*/31*b* to the next target key position and the means current of the driving signal up(t) required for moving the pedals PD to the next target pedal position on the basis of the piece of key position data and the piece of pedal position data, respectively, and adjusts the driving signal UK(t) and driving signal up(t) to the duty ratio equivalent to the mean current and the duty ratio equivalent to the mean current. In order to adjust the driving signals UK(t) and up(t) to the target mean current, a pulse width modulator 42*a* (see FIG. 2) is incorporated in the servo-controller 42.

While the plungers 20*b* and 29 are moving in the magnetic fields, the built-in plunger sensors 20*a* and 27 determines the current key positions and current pedal positions, and periodically reports the current key positions and current pedal positions to the servo-controller 42 as the key position signals yk and pedal position signals yp.

The servo-controller 42 compares the current key positions and current pedal positions with the corresponding target key positions and corresponding pedal positions to see whether or not the keys 31*a*/31*b* and pedals PD exactly travel on the reference key trajectories and reference pedal trajectories. If the answer is given negative, the servo-controller 42 varies the mean current of the driving signals UK(t) and mean current of the driving signals up(t). If, on the other hand, the answer is given affirmative, the servo-controller 42 keeps the means current at the present values.

A piece of music data is assumed to request the controller 3*a* to realize the half pedal state. The motion controller intermittently supplies a series of target pedal position, which guides the damper pedal PD to the half point, to the servo-controller 42, and the servo-controller 42 forces the damper pedal PD to travel on the reference trajectory for the half pedal state. However, the individuality of acoustic piano 1 has the serious influence on the half point. In order exactly to realize the half pedal state, the half point is to be individually determined for the acoustic piano 1. For this reason, the controller 3*a* seeks the half point through a computer program before the automatic playing. The method for determining the half point will be hereinlater described in detail.

System Configuration of Controller

Figure 2:
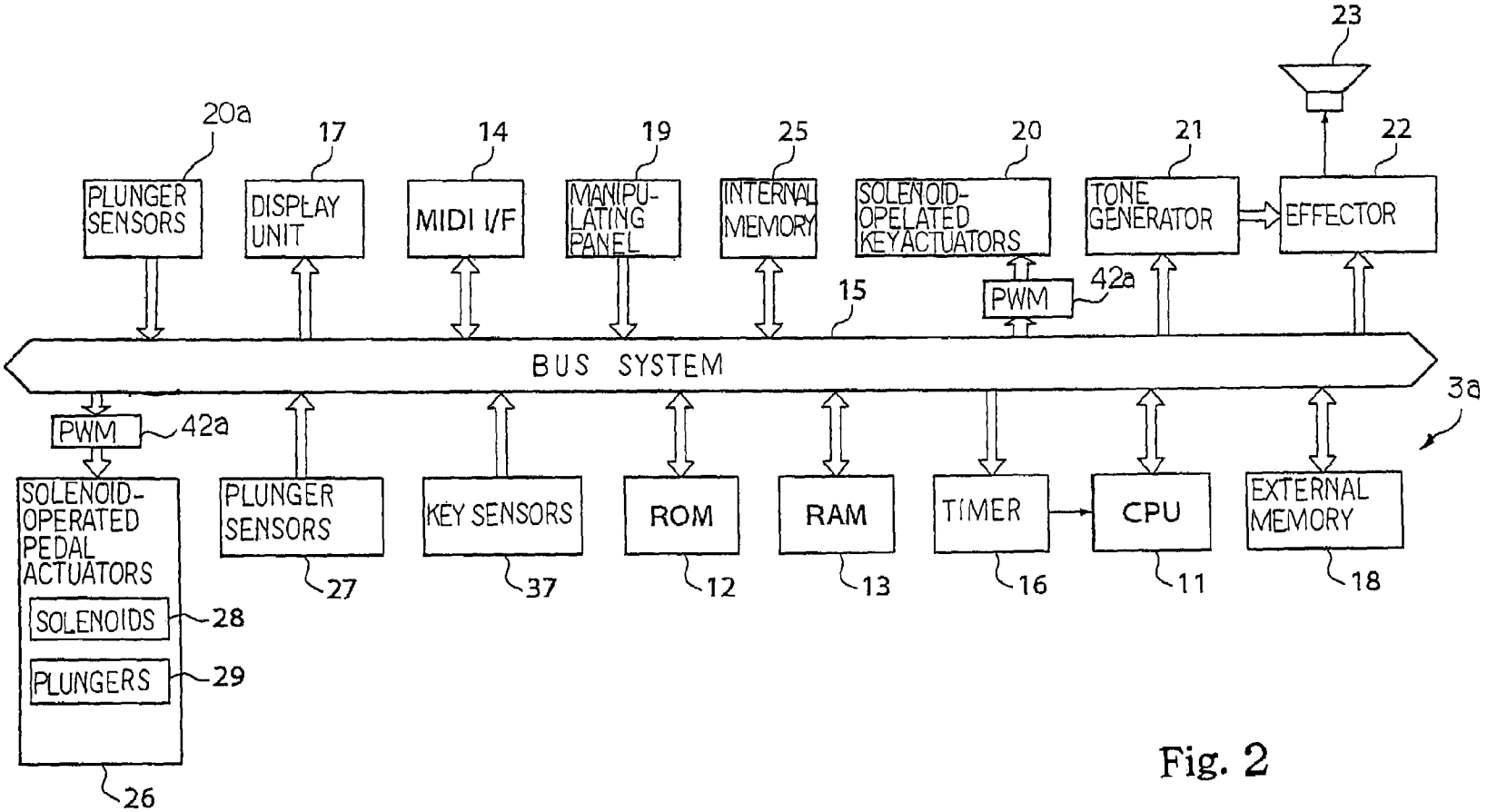
FIG. 2 is a block diagram showing the system configuration of a controller incorporated in the automatic player piano.

Turning to FIG. 2, the controller 3*a* includes a central processing unit 11, which is abbreviated as "CPU", a read only memory 12, which is abbreviated as "ROM", a random access memory 13, which is abbreviated as "RAM", a MIDI interface 14, which is abbreviated as "MIDI/IF", a bus system 15 and a timer 16. The central processing unit 11, read only memory 12, random access memory 13, MIDI interface 14 and timer 16 are connected to the bus system 15, and the central processing unit 11 communicates with other system components through the bus system 15.

The central processing unit 11 is the origin of the data processing capability, and computer programs are stored in the read only memory 12. The central processing unit 11 sequentially fetches program instructions, which form in combination the computer programs, from the read only memory 12, and performs a data processing expressed by the program instructions. Parameter tables and coefficients, which are required for the data processing, are further stored in the read only memory 12. The random access memory 13 offers temporary data storage to the central processing unit 11, and serves as a working memory. The computer programs, which selectively run on the central processing unit 11, realize the functions of piano controller 40, motion controller 41 and servo-controller 42.

Moreover, pieces of test data, which is representative of a simulative pedal trajectory, are stored in the read only memory 12, and the central processing unit 11 determines the half point through the experiment by using the pieces of test data. Description will be hereinlater made on the experiment in detail.

The MIDI interface 14 is connected to another musical instrument or a personal computer system through a MIDI cable, and MIDI music data codes are output from or input to the MIDI interface 14. The lapse of time is measured with the timer 16, and the central processing unit 11 reads the time or lapse of time on the timer 16 so as to determine the timing at which an event is to occur. Moreover, the timer 16 periodically makes the main routine program branch to subroutine programs through timer interruption. The timer 16 may be a software timer.

The controller 3*a* further includes a display unit 17, a manipulating panel 19, the pulse width modulator 42*a*, a tone generator 21, an effector 22, an internal data memory 25 and interfaces connected to an external memory 18, key sensors 37, plunger sensors 20*a*/27 and a sound system 23. These system components 17, 19, 42*a*, 21, 22, 25 and interfaces are also connected to the bus system 15 so that the central processing unit 11 is also communicable with those system components 17-25 and interfaces. The pulse width modulator 42*a* may be integrated with the solenoid-operated key actuators 20. In this instance, the central processing unit 11 supplies a control signal indicative of the target duty ratio of the driving signals through an interface to the pulse width modulator 42*a*.

The display unit 17 is a man-machine interface. In this instance, the display unit 17 includes a liquid crystal panel. Character images for status messages and prompt messages are produced in the display unit 17, and symbols and images of scales/indicators are further produced in the display unit 17 so that the users acquire status information representative of the current status of the automatic player piano 30 from the display unit 17. Images of notes on the staff notation are further produced on the display unit 16, and the users play pieces of music with the assistance of the notes on the staff notation.

Button switches, ten keys and levers are arrayed on the manipulating panel 19. The users selectively push and move the switches, keys and levers so as to give their instructions to the controlling system 3*a*. The pulse width modulator 42*a* is responsive to pieces of control data representative of the mean current of the driving signals UK(t)/up(t) so as to adjust the driving signals UK(t)/up(t) to the target duty ratio.

The tone generator 21 produces a digital audio signal on the basis of the MIDI music data codes, and supplies the digital audio signal to the effector 22. The effector 22 is responsive to the control data codes representative of effects to be imparted to the tones so that the digital audio signal is modified in the effector 22. A digital-to-analog converter is incorporated in the effector 22. The digital audio signal is converted to an analog audio signal, and the analog audio signal is supplied to the sound system 23. The analog audio signal is equalized and amplified, and, thereafter, converted to electronic tones. Thus, the keyboard musical instrument can produce the electronic tones instead of the piano tones generated through the vibrating strings 34.

The internal data memory 25 is much larger in data holding capacity than the random access memory 13, and sets of MIDI music data codes are stored in the internal data memory 25. In this instance, a flash memory is used as the internal data memory 25. Sets of MIDI music data codes are transferred from an external data source through the MIDI interface 14 to the internal data memory 25 or from the external memory 18 through the interface. Various sorts of large-capacity memories are available for the controller 3*a*.

In this instance, the external memory 18 is implemented by a disk driver and portable memory devices such as, for example, flexible disks or compact disks. The key sensors 37 are provided under the front portions of the black and whit keys 31*a*/31*b*, and form parts of the recording system. The key sensors 37 are respectively associated with the black and white keys 31*a*/31*b*, and report the current key positions of the associated black and white keys 31*a*/31*b* to the controller 3*a*. The controller 3*a* analyzes the current key positions so as to determine the key motion. The controller 3*a* codes the pieces of music data, which express the key motion, into the formats defined in the MIDI protocols. Thus, the performance on the keyboard 31 is recorded in a set of MIDI music data codes.

Computer Program for Seeking Half Point

As described hereinbefore, the half point is not strictly identical with the half points of other automatic player pianos due to the individuality of the acoustic pianos. In order to reenact the performance at high fidelity, it is necessary exactly to specify the half point for the acoustic piano 1 through the experiment. In this instance, the half point is expressed as a pedal stroke from the rest position.

Figure 3:
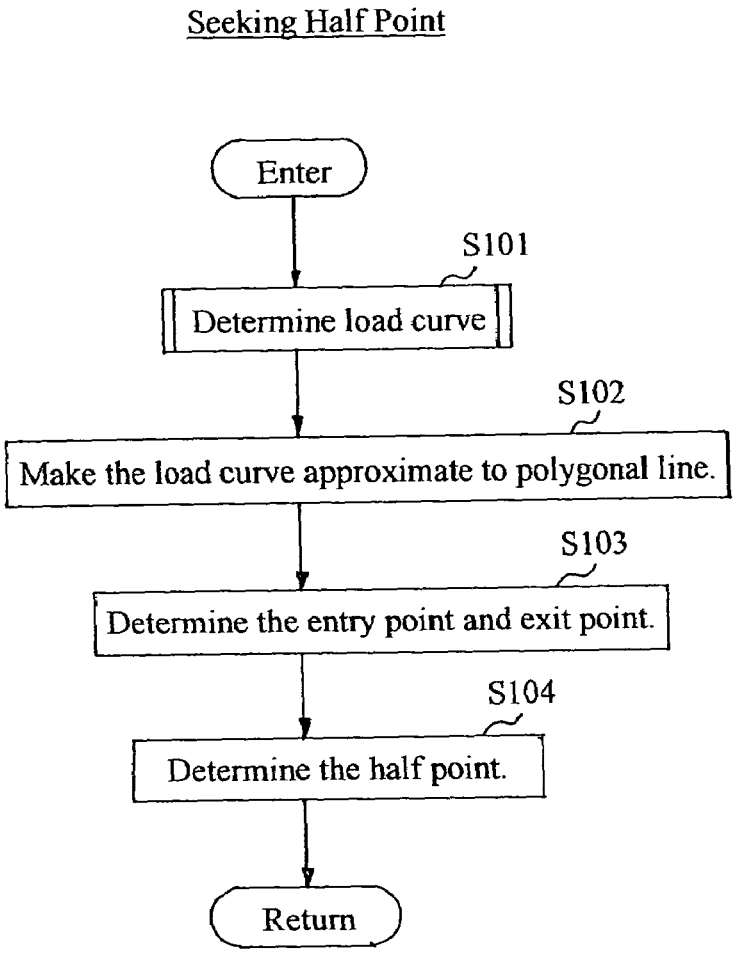
FIG. 3 is a flowchart showing a series of tasks for seeking a half point.

FIG. 3 shows a job sequence realized through a computer program. When the central processing unit 11 is requested to determine the half point pH, the main routine program branches the subroutine program shown in FIG. 3. The central processing unit 11 firstly carries out an experiment so as to obtain a load curve of the damper pedal PD, i.e., mean current-to-plunger stroke characteristic curve of the associated solenoid-operated pedal actuator 26 as by step S101. Plots CA are indicative of the mean current-to-plunger stroke characteristic curve (see FIG. 4). The plunger stroke is equivalent to the pedal stroke so that the abscissa stands for the pedal stroke (st) from the rest position, and the axis of ordinate is indicative of the amount of mean current up (st).

Figure 5:
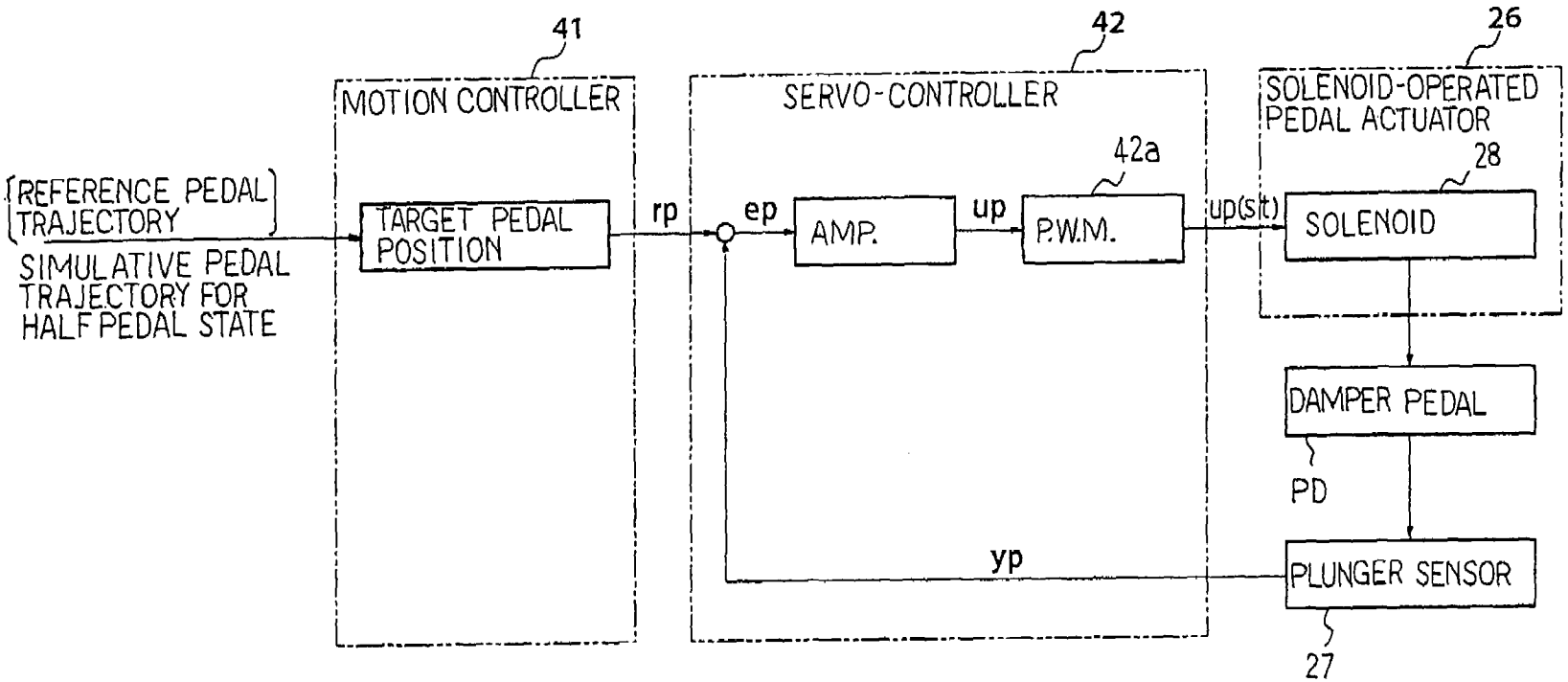
FIG. 5 is a block diagram showing a servo-control loop for a damper pedal.
Figure 6:
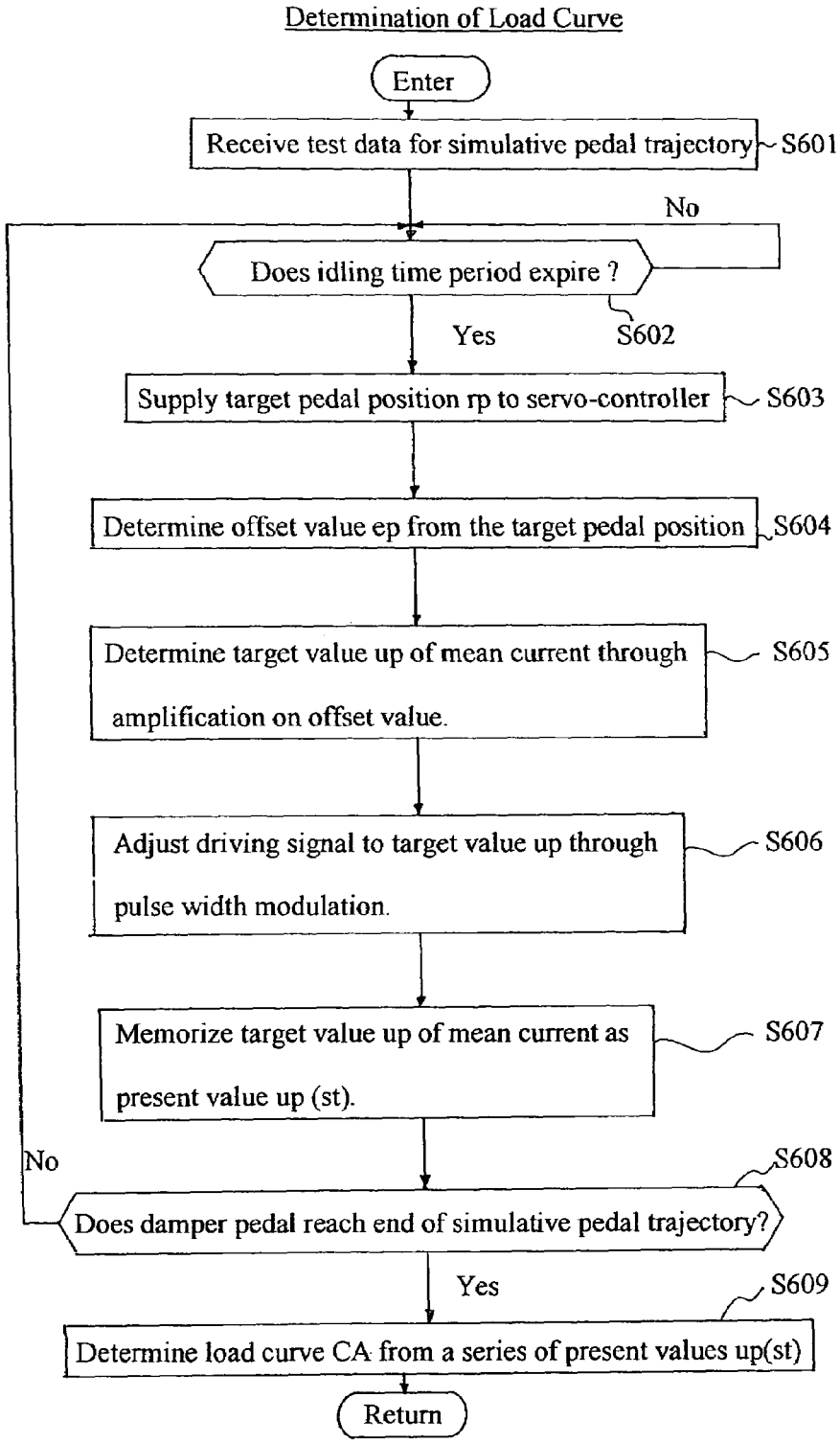
FIG. 6 is a flowchart showing a job sequence for determining a load curve or the mean current-to-pedal stroke characteristics.

The job at step S101 is described in more detail. FIG. 5 shows the servo-control loop incorporated in the automatic player, and FIG. 6 shows a job sequence at step S101 . As shown in FIG. 5, the servo-controller 42, solenoid-operated pedal actuator 26 and built-in plunger sensor 27 form in combination the servo-control loop for the damper pedal PD, and the motion controller 41 intermittently supplies a value of target pedal position rp to the servo-controller 42. Although the motion controller 41 supplies the piece of pedal position data representative of the target pedal position on the basis of the reference pedal trajectory in the automatic playing, the motion controller 41 determines the pedal position on the basis of the simulative pedal trajectory, through which the half pedal state is simulated in the experiment. The pieces of test data are supplied from the piano controller 40 to the motion controller 41, and the motion controller 41 intermittently gives the values of target pedal position to the servo-controller 42. The simulative pedal trajectory gives rise to uniform motion of the damper pedal PD, and the servo-controller 42 forces the damper pedal PD to travel on the simulative pedal trajectory through the servo-control loop. In this instance, the damper pedal PD consumes 4 seconds until the end of the simulative pedal trajectory.

In more detail, the motion controller 41 is assumed to receive the pieces of test data representative of the simulative pedal trajectory as by step S601. In order to achieve the servo-control, the pieces of pedal position data, which represent the target pedal position varied with time, are supplied to the servo-controller 42 at regular intervals equal to the sampling time period for the pedal position signal yp. Each of the regular time intervals is hereinafter referred to as an "idling time period". In this instance, the idling time period is 4 milliseconds. For this reason, the motion controller 41 checks the timer 16 to see whether or not the idling time period is expired as by step S602. If the answer is given negative "No", the motion controller 41 repeats the step S602 until the answer is changed to affirmative.

When the answer is given affirmative "Yes", the motion controller 41 supplies the piece of pedal position data representative of the target pedal position rp to the servo-controller 42 as by step S603. The piece of actual pedal position expressed by the pedal position signal yp is supplied from the built-in plunger sensor 27 to the servo-controller 42 concurrently with the target pedal position rp.

Then, the servo-controller 42 compares the actual pedal position with the target pedal position so as to see determine the offset value ep between the target pedal position and the actual pedal position as by step S604. The servo-controller 42 multiplies the offset value ep with a certain gain, and determines a target value up of mean current through an amplification as by step S605. The servo-controller 42 converts the offset value ep, i.e., difference between the target pedal position and the actual pedal position to the target value up of mean current or duty ratio of the driving signal up(st) through the amplification.

Subsequently, the servo-controller 42 adjusts the driving signal up(st) to the target duty ratio up by means of the pulse width modulator 42*a* as by step S606. The driving signal up(st) is supplied from the pulse width modulator 42*a* to the solenoid of the solenoid-operated pedal actuator 26. The plunger 29 downwardly projects from the solenoid 28, and depresses the damper pedal PD, and the current pedal position or actual pedal position will be reported from the built-in plunger sensor 27 to the servo-controller 42 upon the expiry of the idling time period.

The servo-controller 42 memorizes the target value of mean current or duty ratio in the working memory 13 as a present value of the driving signal up(st) as by step S607, and checks the piece of pedal position data to see whether or not the damper pedal PD reaches the end of the simulative pedal trajectory as by step S608.

When the answer at step S608 is given negative "No", the control returns to step S602, and repeats the control sequence from S602 to S608. Thus, the motion controller 41 and servo-controller 42 reiterates the loop consisting of steps S602 to S608 until the damper pedal PD reaches the end of the simulative pedal trajectory, and accumulates the series of present values of the driving signal up(st) in terms of the actual pedal position in the working memory 13.

When the damper pedal PD reaches the end of the simulative pedal trajectory, the answer at step S608 is changed to "affirmative", and the central processing unit 11 determines the load curve CA on the basis of the series of present values in terms of the actual pedal position as by step S609. Upon completion of the job at step S609, the central processing unit 11 returns to the computer program shown in FIG. 3.

Figure 4:
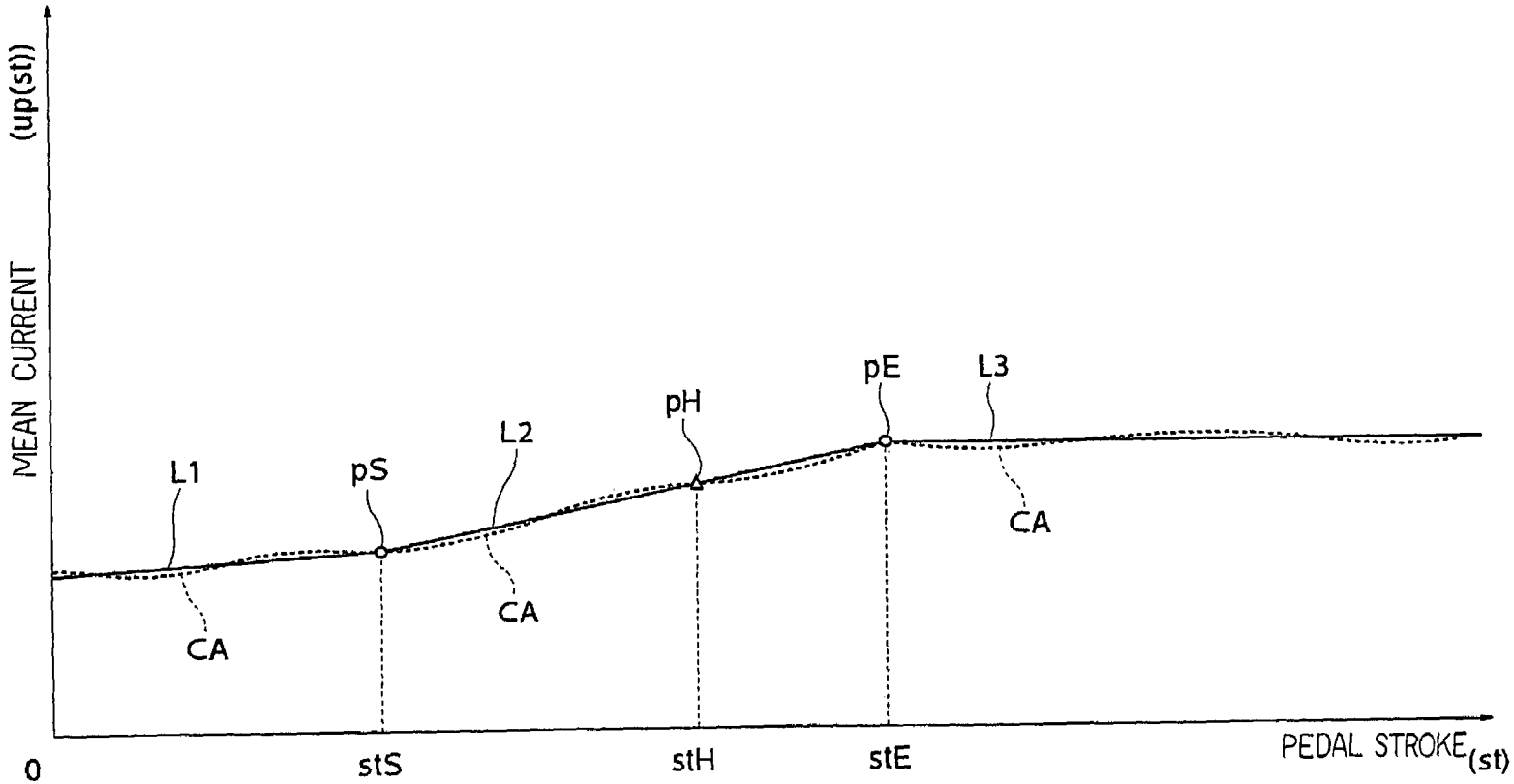
FIG. 4 is a diagram showing mean current-to-pedal stroke characteristics observed in an experiment.

Subsequently, the central processing unit 11 approximates the load curve CA to a polygonal line as by step S102. In this instance, the load curve CA is approximated to three linear lines L1, L2 and L3 as shown in FIG. 4. An appropriate linear approximation technique is employed at step S102. The first linear line L1 is different in gradient from the second linear line L2, and the second linear line L2 is different in gradient from the third linear line L3. The first linear line L1 is to cross the second linear line L2 at pS, and the second linear line L2 is to cross the third linear line L3 at pE.

Upon completion of the job at step S102, the central processing unit 11 tries to determine the entry point and exit point. As described hereinbefore, the load against the pedal motion is increased at the boundary between the rest section and the half pedal section, and is decreased at the boundary between the half pedal section and the open string section. The gradient of second linear line L2 is greater than the gradient of first linear line L1 and the gradient of third linear line L3. From the above-described premises, the entry point and exit point are to be at the boundary between the rest section and the half pedal section and between the half pedal section and the open string section. For this reason, the central processing unit 11 finds the entry point and exit point at pS and pE, respectively, as by step S103. The linear lines L1, L2 and L3 express the rest section, half pedal section and open string section, respectively.

Subsequently, the central processing unit 11 seeks the half point. In this instance, the interior division is employed. The half point pH divides the linear line L2 at the ratio of 2:1, because the ratio of 2:1 makes the half point pH surely fallen within the predetermined range in all the products of the model of grand piano 1. The entry point pE and exit point pE are respectively found at the pedal stroke of stS and pedal stroke of stE so that the central processing unit 11 determines the half point pH at pedal stroke of stH as by step S104. The central processing unit 11 memorizes the half point pH in the working memory 13, and in the internal memory 25 or external memory 18 in the shut-down work. Upon completion of the job at step S104, the central processing unit 11 returns to the main routine program.

When the central processing unit 11 encounters the pieces of music data expressing the half pedal state, the central processing unit 11 makes the piece of MIDI data expressing the pedal stroke of "64", which is nearly equal to the mid of "127" expressing the full pedal stroke, equivalent to the pedal stroke stH at the half point pH, and controls the solenoid-operated pedal actuator 26 for reproducing the half pedal state.

As will be understood, the half point pH is determined for each individual product of the grand piano 1, which forms the part of the automatic player piano, through the experiment, and all the dampers 36 surely enter the half pedal state at the half point pH during the playback of pieces of music. Although the grand piano 1 exhibits its own individuality, the interior division makes the half point pH fallen within the predetermined range in the half pedal section where all the dampers 36 enter the half pedal state. As a result, the automatic player 3 surely reproduces the half pedal state in the playback, and reenacts the performance at high fidelity.

In the experiment, the damper pedal PD is slowly moved from the rest position to the end position through the uniform motion. For this reason, the central processing unit 11 can exactly plot the pedal stroke in terms of the amount of mean current of the driving signal up(t), and correctly approximate the load curve CA to the three linear lines L1, L2 and L3. As a result, the entry point pS, exit point pE and, accordingly, half point pH are exactly determined on the load curve CA.

Second Embodiment

An automatic player piano implementing the second embodiment is similar in structure to the automatic player piano shown in FIGS. 1, 2 and 5. A method for seeking the half point pH is different from that shown in FIGS. 3 and 6. For this reason, the component parts of the automatic player piano implementing the second embodiment are hereinafter labeled with references designating the corresponding component parts of the automatic player piano already described, and description is focused on the method employed in the second embodiment with reference to FIG. 7.

Figure 7:
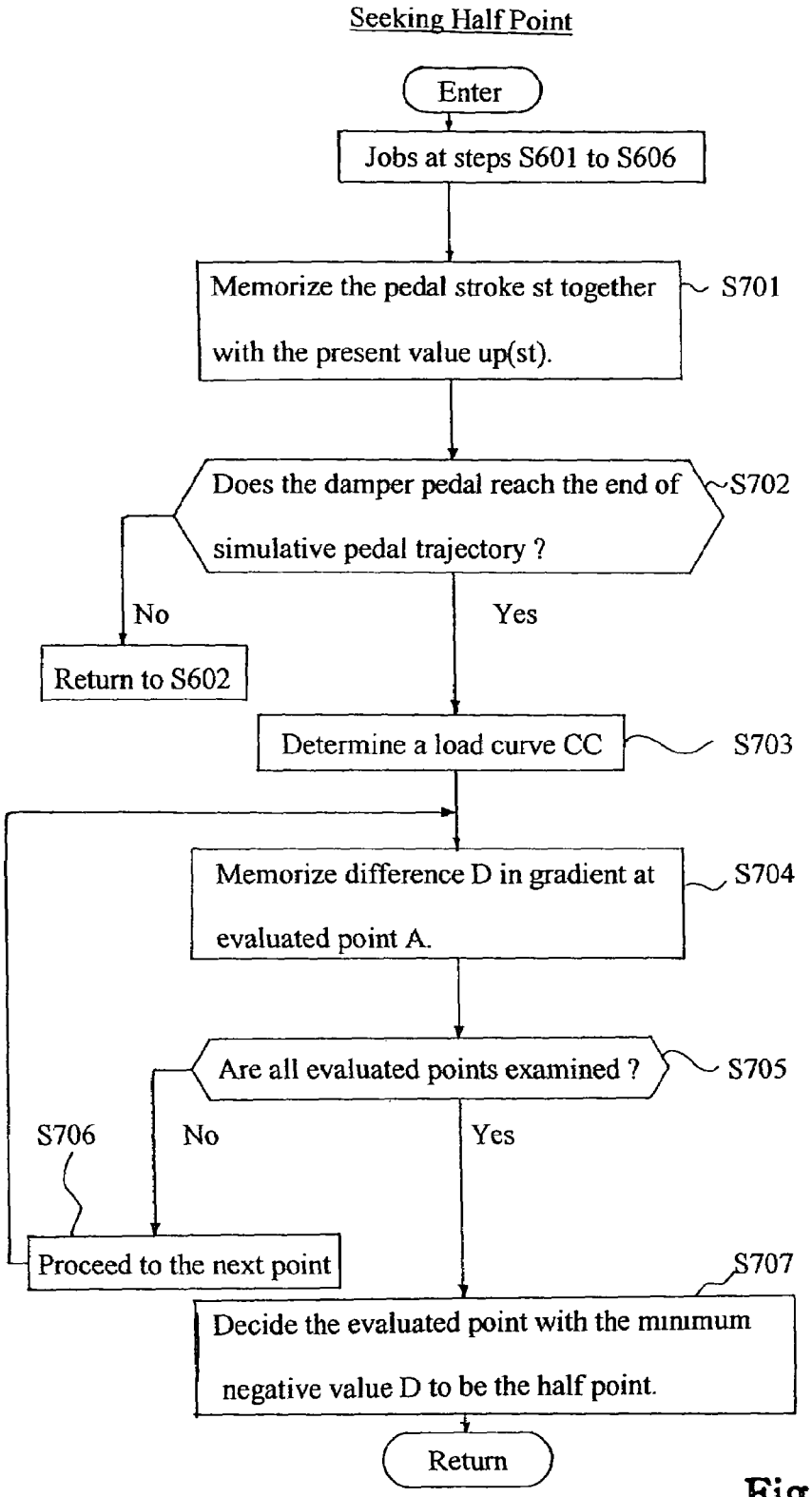
FIG. 7 is a flowchart showing a job sequence for determining a half point in another automatic player piano.

When the central processing unit 11 is requested to determine the half point, the main routine program branches to a subroutine program shown in FIG. 7. Upon entry into the subroutine program, the central processing unit 11 accomplishes the jobs same as those at steps S601 to S606 (see FIG. 6) so as to adjust the driving signal to the target value up. The central processing unit 11 determines a simulative pedal trajectory for the damper pedal PD on the basis of pieces of test data, and controls the pulse width modulator 42*a* to make the damper pedal PD reach the end of the simulative pedal trajectory within about 4 seconds. The central processing unit 11 memorizes the pedal stroke st together with the target value of the amount of mean current or present value up(st) in the working memory 13 as by step S701.

Subsequently, the central processing unit 11 checks the pedal stroke st to see whether or not the damper pedal PD reaches the end of the simulative pedal trajectory as by step S702. While the damper pedal PD is traveling on the simulative pedal trajectory, the answer at step S702 is given negative "No", and the central processing unit 11 returns to step S602. Thus, the central processing unit 11 reiterates the loop consisting of steps S602 to S606, S701 and S702, and gathers the pieces of pedal data expressing the pedal stroke st and the pieces of control data expressing the amount of mean current or duty ratio. The central processing unit 11 repeats the loop at intervals of 4 milliseconds so that a large number of pieces of pedal data are stored in the working memory 13 together with the pieces of corresponding control data.

When the damper pedal PD reaches the end of the simulative pedal trajectory, the answer at step S702 is changed to affirmative "Yes", and the central processing unit 11 determines a load curve CC on the basis of the pieces of pedal data expressing the actual pedal trajectory and pieces of control data expressing the amount of mean current varied together with the pedal stroke st as by step S703.

Figure 8:
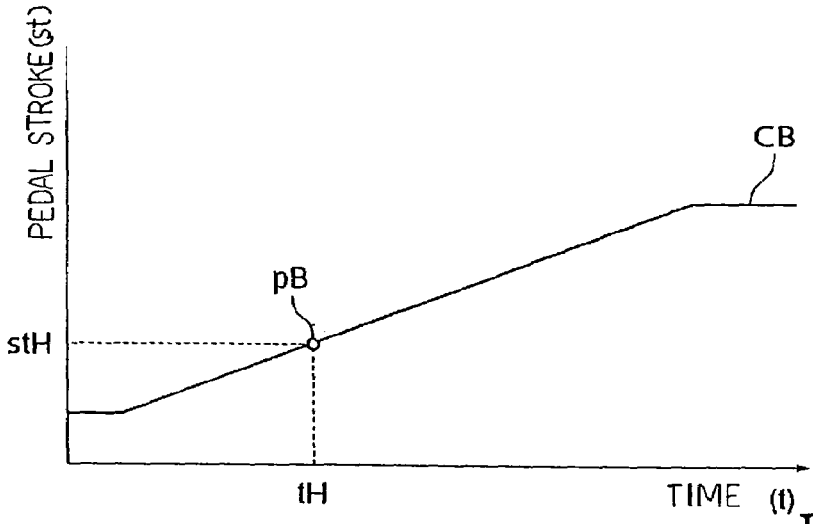
FIG. 8 is a diagram showing a pedal stroke varied with time in an experiment.
Figure 9:
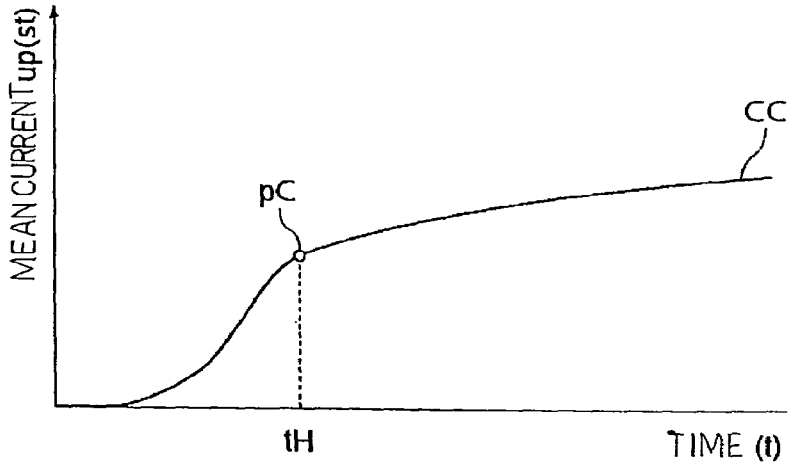
FIG. 9 is a diagram showing the amount of mean current varied with time in the experiment.

The pedal stroke and the amount of mean current up(st) are plotted as indicated by CB and CC as shown in FIGS. 8 and 9. Plots CC is hereinafter called as "load curve".

Figure 10:
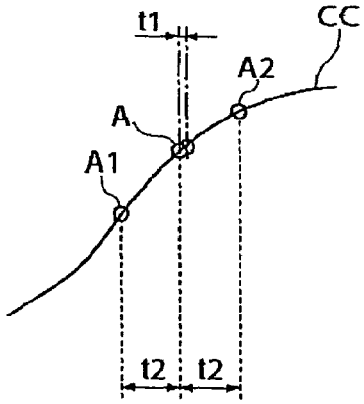
FIG. 10 is a view showing an evaluated point on a load curve determined through the experiment.

Subsequently, the central processing unit 11 determines a difference in gradient at each evaluated point A as by step S704. Each evaluated point A is determined on the load curve CC at intervals of 4 milliseconds, and the first evaluated point A is spaced from the starting time of the experiment by 400 milliseconds. This means that the second evaluated point A is 404 milliseconds after the starting time. The difference D in gradient at each evaluated point A is calculated as follows.

$$D=\{(\mathrm{up}(st) \text{ at } A2)-(\mathrm{up}(st) \text{ at } A)\}/t2-\{(\mathrm{up}(st) \text{ at } A)-(\mathrm{up}(st) \text{ at } A)-(\mathrm{up}(st) \text{ at } A1)\}/t2$$

where A1 is indicative of the time earlier than present time by t2, A2 is indicative of the time later than the present time by t2, t2 is a regular time period of 400 milliseconds and t1 is indicative of each of the time intervals of 4 milliseconds as shown in FIG. 10.

When the difference D is calculated, the central processing unit 11 memorizes the difference D in the working memory 13, and compares the lapse of time (t) with the time period to be consumed until the end of the simulative pedal trajectory to see whether or not the difference D is calculated at all the evaluated points as by step S705.

If the lapse of time is shorter than about 4 seconds, the answer at step S705 is given negative "No", and the central processing unit 11 calculates the difference D in gradient for the next evaluated point A as by step S706. Thus, the central processing unit 11 reiterates the loop consisting of steps S704 to S706 until the difference D in gradient is memorized for the last evaluated point A.

When the difference D is memorized for the last evaluated point A, the answer at step S705 is changed to affirmative "Yes", and the central processing unit 11 proceeds to step S707. The central processing unit 11 searches the working memory for the evaluated point A with the minimum negative value of the difference D. The minimum negative value means the largest absolute value with the negative sign. When the central processing unit 11 finds a point pC as the evaluated point A with the minimum negative value D, the central processing unit 11 specifies the time tH at which the amount of mean current was sampled (see FIG. 9), and decides the pedal stroke stH to be the half point (see FIG. 8). Upon completion of the job at step S707, the central processing unit 11 returns to the main routine program.

As will be understood, the central processing unit 11 seeks the certain inflection point pC, at which the rate of increase is reduced most drastically, on the load curve CC, and decides the certain inflection point pC to be the half point pB. The rate of increase of the mean current up(st) is reduced most drastically at the certain inflection point pC, and the difference D in gradient has the minimum negative value at the certain inflection point pC. The part of load curve around the certain inflection point pC is shaped like an upward convex.

The half point pC is corresponding to the pedal stroke at the exit point pE on the load curve CA shown in FIG. 4. In other words, the half point pC is found at the point which divides the half pedal section L2 at 10:1.

As will be appreciated from the foregoing description, the automatic player according to the present invention previously decides the half point on the pedal trajectory so that the half pedal state is surely reproduced in the playback. This results in that the automatic player piano reenacts the original performance at high fidelity on the basis of the pieces of music data expressing the original performance.

Although particular embodiments of the present invention have been shown and described, it will be apparent to those skilled in the art that various changes and modifications may be made without departing from the spirit and scope of the present invention.

Although the motion controller 41 and servo-controller 42 once accomplish the jobs shown in FIG. 6 for determining the load curve CA, they may multiplily repeat the series of jobs, and determines the load curve CA on the basis of the plural sets of present values. Otherwise, the central processing unit 11 averages the present values of the plural sets, and determines the load curve CA on the basis of the mean values.

The grand piano 1 may be replaced with an upright piano. The acoustic piano, i.e., grand piano and upright piano do not set any limit to the technical scope of the present invention. The present invention may be applied to another sort of automatic player musical instrument fabricated on the basis of another musical instrument such as, for example, a mute piano, a keyboard for a practice usage or a celesta.

The ratio of 2:1 does not set any limit to the technical scope of the present invention. Another ratio such as 5:3, 7:3 or 7:4 may be appropriate for another model of grand piano or an upright piano.

The interior division does not set any limit to the technical scope of the present invention. Even though the exit point pE is different among the products, the distance between the exit point pE and a certain point in the predetermined range is constant, and the manufacturer may make the certain point serve as the half point. In this instance, the central processing unit 11 subtracts the distance from the pedal stroke stE so as to determine the half point pH. Moreover, the mathematically unique point may be defined through an exterior division.

The approximation to the polygonal line does not set any limit to the technical scope of the present invention. The central processing unit 11 may seek one of more than one inflection point on the load curve CA so as to determine the half point pH.

In the second embodiment, the central processing unit 11 calculates the difference D in gradient at all the evaluated points possible to be examined. However, the load on the central processing unit 11 is too heavy. The central processing unit in another embodiment may calculate the difference D in gradient in a narrow section on the load curve where the certain inflection point is possibly found.

The central processing unit 11 may repeat the calculation. In this instance, plural candidates are found on the load curve for the half point pC, and the central processing unit 11 selects the most appropriate one from the plural candidates. If the difference in pedal stroke between the farthest candidate and the nearest candidate, the central processing unit 11 notifies the user of the failure, and recommends him or her to carry out the experiment, again.

The method employed in the second embodiment may be applied to the automatic player implementing the first embodiment. In detail, the central processing unit 11 finds the entry point pS and exit point pE on the load curve CA through the method. The entry point pS is to be found at the inflection point at which the difference D in gradient has the maximum positive value. When both entry and exit points pS and pE are to be sought, the central processing unit searches the local maximums on a curve expressing the absolute value of the difference D in gradient for these points pS and pE.

The uniform motion on the simulative pedal trajectory does not set any limit on the technical scope of the present invention. The sort of motion to be employed is dependent on the servo-control technique.

The solenoid-operated pedal actuators 26 do not set any limit on the technical scope of the present invention. Fluid actuators or torque motors may be employed in the automatic player.

The built-in plunger sensors 27 do not set any limit to the technical scope of the present invention. It is possible to replace the built-in plunger sensors 27 to suitable potentiometers directly monitoring the pedals 26, because the plunger stroke is equivalent to the pedal stroke.

Although the dynamic experiment, in which the damper pedal PD is moved along the simulative pedal trajectory through the servo-control, is carried out for seeking the half point, the damper pedal PD statically changes the pedal position for the load curve CA or CC. In other words, the mean current up(st) is stepwise increased for bringing the plunger to predetermined strokes, and the amount of mean current up(st) to be required is plotted.

In the first and second embodiments, the damper pedal PD is moved from the rest position to the end position on the simulative pedal trajectory. The damper pedal may be moved from the end position to the rest position along the simulative pedal trajectory in another embodiment. Otherwise, the damper pedal PD may be reciprocally moved between the rest position and the end position along the simulative pedal trajectory, and the values of mean current are averaged for the load curve CA and CC.

The damper pedal PD may travel on a part of the rest section, entire half pedal section and a part of the open string section. In other words, the simulative pedal trajectory is not overlapped with the entire pedal trajectory between the rest position and the end position.

In case where the damper pedal PD is moved from the end position to the rest position through the uniform motion, the half point is found at the rate of decrement of the mean current up(st) enlarged most drastically. In an ideal automatic player piano, the half point found in the forward motion is consistent with the half point in the backward motion.

In FIGS. 4 and 9/10, the axis of ordinate is indicative of the actual pedal stroke st represented by the pedal position signal yp. However, the axis of ordinate may be indicative of the target pedal stroke on the simulative pedal trajectory or the corresponding value of the pedal stroke memorized in the MIDI music data codes. Similarly, the abscissa may be indicative of another physical quantity expressing the magnetic force exerted on the plunger 29.

The damper pedal does not set any limit to the technical scope of the present invention. The present invention is applicable to any manipulator which the player brings to a point on the way to the end position during the performance. For example, in case where the automatic player piano is fabricated on the basis of an upright piano, the present invention is applicable to the soft pedal. Of course, the present invention is applicable to the soft pedal of an automatic player piano is fabricated on the basis of the grand piano.

The computer program may be loaded from an information storage medium to a suitable memory device incorporated in the controller 3*a*, or supplied from a suitable program source through a communication network to the memory. The suitable memory device may be a floppy disk (trademark), a hard disk, a compact disk such as CD-ROM, CD-R, CD-RW, a photo-electro-magnetic disk, a piece of magnetic tape, a non-volatile memory card and a DVD (Digital Versatile Disk) such as DVD-ROM, DVD-RAM, DVD-RW, DVD+RW.

The subroutine program for seeking the half point may be installed together with the new version of the subroutine program for the automatic playing. In this instance, the subroutine program for seeking the half point and subroutine program for the automatic playing selectively run on the central processing unit 11 under the control of a suitable operating system.

The computer program, which includes the subroutine program for seeking the half point, may be loaded from a suitable information storage medium to a memory on an expansion board or an expansion unit. If a microprocessor is further mounted on the expansion board or expansion unit, the microprocessor may execute the instruction codes of the subroutine program for seeking the half point, and the pieces of control data expressing the half point are written in the memory incorporated in the controller 3*a*.

Claim languages are correlated to the component parts of the embodiments as follows. The black and white keys 31*a*/31*b* serve as "plural manipulators", and the hammers 32, action units 33, strings 34 and dampers 36 as a whole constitute a "tone generator". The solenoid-operated key actuators 20 are corresponding to "plural actuators", and the solenoid-operated pedal actuator 26 serves as an "actuator". The rest section, half pedal section and open string section are respectively corresponding to a "rest section", a "half section" and an "end section. The pieces of control data representative of the pedal stroke (st) serve as "pieces of control data", and the amount of mean current is equivalent to "pieces of driving data". The half points pH and pC/pB are corresponding to a "mathematically unique point".

What is claimed is:

1. An automatic player for reenacting a performance on a musical instrument having plural manipulators for specifying the pitch of tones, a tone generator for producing said tones at said pitch and at least one manipulator for imparting an effect and another effect to said tones depending upon a stroke from a rest position, comprising:

plural actuators associated with said plural manipulators and selectively energized for moving said plural manipulators between said rest positions and said end positions, an actuator associated with said at least one manipulator and energized for moving said at least one manipulator into an end section in the presence of a piece of music data representative of said effect and into a half section in the presence of another piece of music data representative of said another effect, a trajectory for said at least one manipulator being dividable into a rest section, said half section and said end section, a sensor producing pieces of control data representative of an actual position of said at least one manipulator on said trajectory, and a controller connected to said plural actuators, said actuator and said sensor and responsive to pieces of music data representative of a music passage so as selectively to energize said plural actuators and said actuator for producing said music passage, said controller being further responsive to pieces of test data representative of a simulative trajectory so as to move said at least one manipulator along said simulative trajectory overlapped with at least a part of said rest section, said half section and a part of said end section, thereby gathering said pieces of control data respectively paired with pieces of driving data representative of load on said actuator, said controller analyzing said pieces of control data respectively paired with said pieces of driving data so as to determine a mathematically unique point in said half section through arithmetic operations, whereby said controller brings said at least one manipulator to said mathematically unique point in the presence of said another piece of music data for imparting said another effect to said tones.

2. The automatic player as set forth in claim 1, in which said arithmetic operations result in an interior division so that said mathematically unique point divides said half section at a predetermined ratio.

3. The automatic player as set forth in claim 2, in which said predetermined ratio is 2:1.

4. The automatic player as set forth in claim 2, in which said pieces of control data respectively paired with said pieces of driving data are approximated to linear lines crossing one another at an entry point of said half section and an exit point of said half section, and said mathematically unique point is specified on one of said linear lines drawn between said entry point and said exit point through said interior division.

5. The automatic player as set forth in claim 1, in which said pieces of control data respectively paired with the pieces of driving data are approximated to a load curve having at least one inflection point, and the mathematically unique point is determined at said at least one inflection point.

6. The automatic player as set forth in claim 5, in which said controller determines a difference in gradient on the load curve at intervals, and said difference is reduced at said at least one inflection point most drastically.

7. The automatic player as set forth in claim 1, in which said at least one manipulator is forced to travel on said simulative trajectory through a servo control technique so as to give rise to uniform motion.

8. A musical instrument for producing tones, comprising:

plural manipulators selectively moved from respective rest position to respective end positions for specifying the pitch of said tones;

a tone generator connected to said plural manipulators, and responsive to the manipulators moved toward said end positions for producing the tones at the specified pitch;

at least one manipulator moved between a rest position and an end position through a rest section, a half section and an end section, and imparting an effect to said tones in said end section and another effect to said tones in said half section; and an automatic player including plural actuators associated with said plural manipulators and selectively energized for moving said plural manipulators between said rest positions and said end positions, an actuator associated with said at least one manipulator and energized for moving said at least one manipulator into said end section in the presence of a piece of music data representative of said effect and into said half section in the presence of another piece of music data representative of said another effect, a sensor producing pieces of control data representative of an actual position of said at least one manipulator on a trajectory between said rest position and said end position, and a controller connected to said plural actuators, said actuator and said sensor and responsive to pieces of music data representative of a music passage for selectively energizing said plural actuators and said actuator, said controller being further responsive to pieces of test data representative of a simulative trajectory for moving said at least one manipulator along said simulative trajectory overlapped with at least a part of said rest section, said half section and a part of said end section for gathering said pieces of control data respectively paired with pieces of driving data representative of load on said actuator, said controller analyzing said pieces of control data respectively paired with said pieces of driving data so as to determine a mathematically unique point in said half section through arithmetic operations, whereby said controller brings said at least one manipulator to said mathematically unique point for imparting said another effect to said tones.

9. The musical instrument as set forth in claim 8, in which said arithmetic operations result in an interior division so that said mathematically unique point divides said half section at a predetermined ratio.

10. The musical instrument as set forth in claim 9, in which said predetermined ratio is 2:1.

11. The musical instrument as set forth in claim 9, in which said pieces of control data respectively paired with said pieces of driving data are approximated to linear lines crossing one another at an entry point of said half section and an exit point of said half section, and said mathematically unique point is specified on one of said linear lines drawn between said entry point and said exit point through said interior division.

12. The musical instrument as set forth in claim 8, in which said pieces of control data respectively paired with the pieces of driving data are approximated to a load curve having at least one inflection point, and the mathematically unique point is determined at said at least one inflection point.

13. The musical instrument as set forth in claim 12, in which said controller determines a difference in gradient on the load curve at intervals, and said difference is reduced at said at least one inflection point most drastically.

14. The musical instrument as set forth in claim 8, in which said at least one manipulator is forced to travel on said simulative trajectory through a servo control technique so as to give rise to uniform motion.

15. The musical instrument as set forth in claim 8, in which black and white keys, a combination of action units, hammers, strings and dampers and a damper pedal serve as said plural manipulators, said tone generator and said at least one manipulator.

16. The musical instrument as set forth in claim 15, in which said damper pedal makes said dampers perfectly pressed to said strings in a rest section close to a rest position of said damper pedal, reduce force on said strings and stepwise spaced from the associated strings in a half pedal section continued to said rest position and perfectly remove said force from said strings in an open string section close to an end position of said damper pedal.

17. The musical instrument as set forth in claim 16, in which said controller approximates the pieces of control data respectively paired with the pieces of driving data in said rest section, the pieces of control data respectively paired with the pieces of driving data in said half pedal section and the pieces of control data respectively paired with the pieces of driving data in said open string section to three linear lines, and determines said mathematically unique point on the linear line for said half pedal section through an interior division.

18. The musical instrument as set forth in claim 16, in which said controller approximates the pieces of control data respectively paired with the pieces of driving data for said half pedal section to a load curve, and calculates a difference in gradient on said load curve at intervals so as to determine said mathematically unique point at an inflection point at which said difference is reduced most drastically.

19. A method for seeking a mathematically unique point for at least one manipulator different from plural manipulators used in a music performance for specifying the pitch of tones, comprising the steps of:

a) determining a simulative trajectory containing a part of a rest section, a half section and a part of an end section for said at least one manipulator of a musical instrument on the basis of pieces of test data;

b) moving said at least one manipulator along said simulative trajectory by means of an actuator so as to gather pieces of control data representative of an actual position of said at least one manipulator respectively paired with pieces of driving data representative of a load on said actuator; and c) analyzing said pieces of control data respectively paired with said pieces of driving data so as to determine a mathematically unique point in said half section through arithmetic operations so that said at least one manipulator is brought into said mathematically unique point for imparting an effect to said tones.

20. The method as set forth in claim 19, in which said step c) includes the sub-steps of c-1) approximating said pieces of control data respectively paired with said pieces of driving data to three linear lines corresponding to said rest section, said half section and said end section, respectively, and c-2) specifying said mathematically unique point at which the linear line for said half section is divided at a predetermined ratio.

21. The method as set forth in claim 19, in which said step c) includes the sub-steps of.

c-1) approximating said pieces of control data respectively paired with said pieces of driving data to a load curve, c-2) calculating a difference in gradient on said load curve at intervals, c-3) searching the values of said difference for a point at which said difference in gradient is reduced most drastically, and c-4) determining said mathematically unique point at said point.

* * * * *